United States Patent [19]

Wallace, Jr.

[11] Patent Number: 4,951,596

[45] Date of Patent: Aug. 28, 1990

[54] INDICATING MEANS FOR MEDICATION CONTAINERS

[76] Inventor: Jack B. Wallace, Jr., 436 Snyder Ave., Aromas, Calif. 95004

[21] Appl. No.: 317,832

[22] Filed: Mar. 1, 1989

[51] Int. Cl.[5] ..... G09F 9/40

[52] U.S. Cl. ..... 116/321; 116/308; 116/323; 40/310; 40/490

[58] Field of Search ..... 116/308, 323, 321, 324, 116/DIG. 23, 322; 40/306, 310, 316, 490, 491, 649, 663

[56] References Cited

U.S. PATENT DOCUMENTS

| | | | |
|---|---|---|---|
| 710,708 | 10/1902 | McShane | 116/308 |
| 1,421,219 | 6/1922 | Harmon | 40/310 |
| 2,625,131 | 1/1953 | Stuhahn | 116/308 |
| 2,641,073 | 6/1953 | Major | 40/310 |
| 2,683,946 | 7/1954 | Olson | 40/490 |
| 3,996,879 | 12/1976 | Walton | 116/308 |
| 4,268,986 | 5/1981 | Piana | 40/316 |
| 4,619,221 | 10/1986 | Lindstromberg | 116/307 |
| 4,712,504 | 12/1987 | Zarley et al. | 116/222 |
| 4,860,684 | 8/1989 | Al-Harbi | 116/308 |
| 4,877,119 | 10/1989 | Hosking | 206/459 |

*Primary Examiner*—William A. Cuchlinski, Jr.
*Assistant Examiner*—W. Morris Worth
*Attorney, Agent, or Firm*—Skjerven, Morrill, MacPherson, Franklin & Friel

[57] ABSTRACT

The invention provides an indicating device in the form of a holder for symbol elements. The device has a body portion that is attached to a c-section clamp. The c-section clamp is adapted to be springly engaged with the object to which the device is to be connected. Symbol elements are positioned along the body portion's guide track for selective alignment with a viewing aperture. This viewing aperture slides parallel to the face of the body portion so that each symbol element can be viewed individually, if so desired.

7 Claims, 2 Drawing Sheets

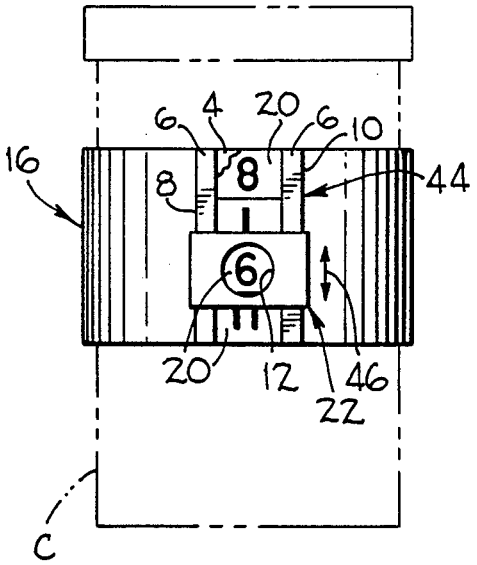
Fig_1
Fig_2
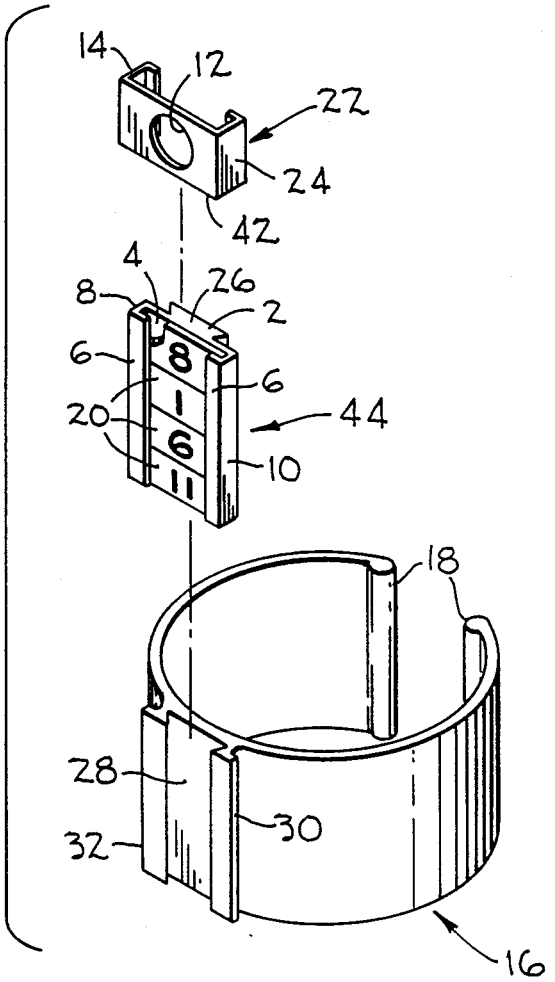
Fig_3
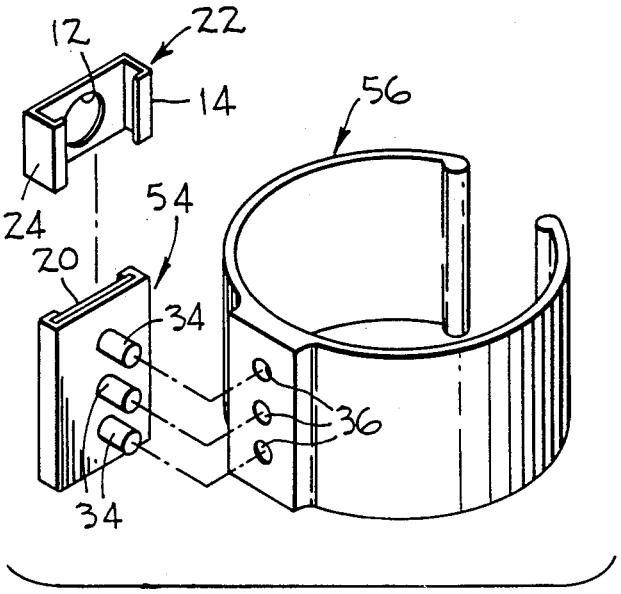
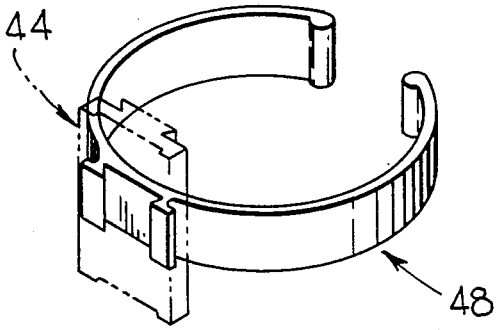
Fig_4

INDICATING MEANS FOR MEDICATION CONTAINERS

BACKGROUND

1. Field of Invention

This invention relates to indicating devices, and more particularly to devices which may be used for timing the application or ingestion of medication, although not limited thereto.

2. Description of Prior Art

Some of the devices of the prior art, as in the Jan. 13, 1950 patent 2,625,131 by Sturhahn, are comprised of a dial portion, or face member, one or more hands which are mounted on said face member for adjustable disposition with respect thereto.

On the other hand, some of the prior art provide an identification device in the form of a holder of symbol elements. The identification device in patent 4,268,986 to Piana, 1981 May 26, provides for a one-piece device manufactured from an elaborate process that includes the use of two different types of plastic. This is an expensive and time-consuming process which results in a device that is difficult to fit symbol elements into. Piana's device is for the purpose of identification only. He does not provide for a means of indicating each symbol element individually. The utilization of a one-piece design, along with the basic manufacturing material—a resilient plastic that has a limited physical property—presents the disadvantage that the device can only accommodate a very small change in range to what it can be attached to. (That is, one size will not fit all.)

Another type of device is comprised of a separate storage container with a variety of symbol elements mounted thereto. These containers have separate compartments for morning, noon, evening and bedtime. Each symbol element is integral with the compartment and is not programmable by the user. These containers store several different medications in each compartment all at the same time. This device presents the disadvantage that the product to be identified is separated from the original labeled container. The user then must rely on his own memory and judgement as to what the product was that has been transferred. The user may find this very confusing. The transferring of the product from one labeled container to another symboled storage device can have very serious consequences. For example, one white tablet is for one thing and the other white tablet is for another.

OBJECTS AND ADVANTAGES

It is among the objects of the present invention to provide an indicating device of the type referred to herein. Some of the objects are:

To supply an indicating device in the form of holders for individual tabs, cards or other elements carrying symbols, letters, numbers or the like. Such elements will be referred to hereinafter as "symbol element" when referring to these elements generally.

To provide an indicating device in the form of a holder of symbol elements which can be easily connected to and disconnected from the original labeled component to be indicated, yet will hold the symbol elements as effectively as the presently known indicating devices of the type to which the invention relates.

To provide a light-weight, easy-to-use, easy-to-produce, long-lasting, fully-transferable indicating device of the type to which the invention relates.

To provide in such a device a way of indicating each symbol element separately. This will allow for the programming of the invention with the above described symbol elements for the purpose of translating the user's abstract dosing schedule to more easily recognizable terms. As an example, the general term "twice a day" can be translated to the more specific and more easily recognized 8 AM and 8 PM. This invention then would help users deal with the great problem of compliance and doubling up on or skipping of the user's medication.

To furnish space on an indicating device for the name of a merchant and his advertising or the addition of auxiliary warning labels or the like.

To provide a device wherein the labeled component to be identified will be protected by a sleeve which remains associated with the labeled component, yet permits the label to be viewed thru the sleeve without disassociating the sleeve from the component.

This invention provides many advantages over the prior art. One of which is the ease of use. Once the device is programmed with the desired symbol elements, the invention can be transferred from one container to another without the need of any readjustment of the symbol elements. With the addition of the sliding viewing aperture member, the invention can easily identify each symbol element individually which will drastically increase the invention's usefulness. This allows the invention not only to be used for identification purposes, but also in a manner similar to that of a medication timer. Also, the viewing aperture can be used as a reference to whether medication has been taken or should be taken by the placement of the viewing aperture. This allows the user to monitor their ingestion of medication by the use of positive visual and lasting reinforcement.

This invention has the advantage that there are no cumbersome dials that need to be adjusted or dials that may have been inadvertently readjusted in error. Again, once the invention is programmed with the desired symbol elements, the device can be used for long periods of time without the need to readjustment, if so desired.

With the design of detachable c-section rings the invention can accommodate a wide range of different sized components that it can be attached to. This is a very practical and economical advantage over the prior art. This invention is simple and inexpensive, yet provides a clearly visible and readily understood indication of the user's medication needs.

This invention then comprises the features fully described and as particularly pointed out in the claims, the following description and annexed drawings setting forth in detail certain illustrative embodiments of the invention. These being indicative of, but several number of ways in which the principles of the invention will become apparent from a consideration of the drawings and ensuing description of it.

SUMMARY OF THE INVENTION

The present invention is specifically directed to overcome the above discussed problems in a novel and simple manner.

According to the invention, a medication indicating device is provided having a slidable symbol element indicating member defining a viewing aperture. Different symbol elements are provided on a guide track upon which the indicating member is slidably mounted. The user selects the desired symbol elements that match the corresponding medication dosing schedule and inserts them into the guide track. After the administering of the medication, the viewing aperture is superimposed over the next selected symbol element. This procedure is repeated in like fashion so that the user can time the administration of medication. This also would help the user not skip or double up on his medication.

DRAWING REFERENCE NUMBERS

2 GUIDE TRACK
4 BODY PLATE DISPLAY SURFACE
6 TURNED EDGE FLANGES
8 FIRST GUIDE EDGE OF 44
10 SECOND GUIDE EDGE OF 44
12 HOLE IN VIEWING SLIDE
14 L-SHAPED LEG OF 22
16 C-SECTION RING
18 EDGE of 16
20 SYMBOL ELEMENTS
22 VIEWING APERTURE
24 L-SHAPED LEG OF 12
26 DOVE TAIL PROJECTION
28 DOVE TAIL GROVE
30 C-SECTION RING FIRST L-SHAPED LEG OF 16
32 C-SECTION RING SECOND L-SHAPED LEG OF 16
34 PEGS
36 COMPLEMENTARY HOLES FOR 34
38 T-SHAPED LEG OF 2
40 PRESSURE SENSITIVE LABELS
42 VIEWING APERTURE WALL
44 BODY PLATE
46 SLIDING DIRECTION
48 NARROW C-SECTION RING
50 TWO GUIDE TRACKS
52 FLAT BODY PLATE
54 MODIFIED BODY PLATE WITH PEGS 34
56 MODIFIED C-SECTION RING
58 MODIFIED VIEWING APERTURE
60 MODIFIED BODY PLATE WITH TWO GUIDE TRACKS 50
62 ALTERNATE C-SECTION RING

DRAWING FIGURES

An embodiment of the invention will now be described by way of example, with reference to the accompanying drawing, wherein.

FIG. 1 is a perspective view of the preferred form of the invention attached to a container;

FIG. 2 is an exploded perspective view showing the relationship of the major components—a body plate, a slide containing viewing aperture and a c-section clamp;

FIG. 3 is an exploded perspective view showing an alternate form of attachment of the body plate and the c-section clamp;

FIG. 4 shows in perspective view a device according to a first embodiment of the invention wherein the c-section clamp is narrowed;

DETAILED DESCRIPTION OF THE INVENTION

Figure 5:
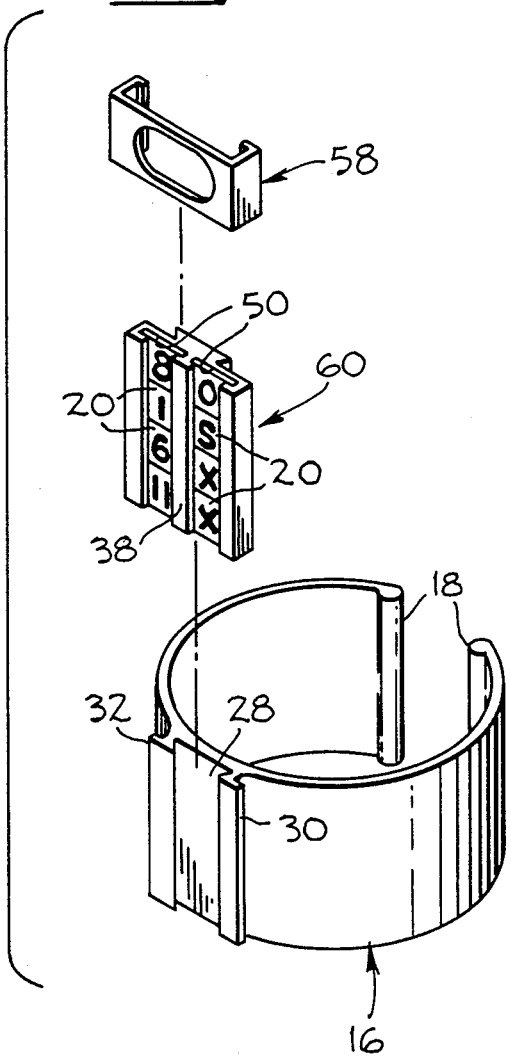
FIG. 5 is an exploded perspective view showing a second embodiment of the body plate, slide and the preferred form of c-section clamp.

In the embodiment illustrated in FIGS. 1 and 2, plate body 44 comprises a guide track 2 that has a flat display surface 4 wherein symbol elements 20 representing symbols, letters, numbers or the like are carried. Guide track 2 has vertically-spaced, turned-edge flanges 6 projecting fowardly from display surface 4. Flanges 6 define two outer guide edges 8 and 10 respectively, for controlled, adjustable sliding movement of a slide 22 having a viewing aperture 12 therein.

Slide 22 defines wall 42 and, attached thereto, rearward extending L-shaped legs 14 and 24 which slidingly embrace end flanges 6 of guide track 2 to permit relative sliding movement of viewing aperture 12 along the length of guide track 2.

C-section clamp 16, or an open sleeve, has along the ends of the opening body, is thickened as shown by reference number 18. C-section clamp 16 has vertical spaces, L-shaped legs 30 and 32 which forms dove tail groove 28. Body plate 44 can be easily connected to and disconnected from c-section clamp 16 with a suitable tongue and groove arrangement, the resilient connection being achieved by the use of dove tail projection 26 of body plate 44, which can engage with dove tail groove 28 of c-section clamp 16.

The invention can be connected to a container simply by pushing it laterally against the container, which has the effect of causing the thickened ends 18 to spread and spring over the container. The body of c-section clamp 16 serves for the resilient gripping of the container thereby to ensure that the invention is held firmly thereto. The invention can be removed in similar fashion or simply by sliding the device off of the container.

In operation, slide 22 and viewing aperture 12 are slidably adjusted relative to guide track 2 along the line designated by the double-headed arrow 46 of FIG. 1 until the next selected symbol element 20 is visible in viewing aperture 12.

FIG. 3 shows an alternate method of attaching plate body 54 and c-section clamp 56. Body plate 54 has plurality of pegs 35, which are fastened together to c-section ring 56 in their complementary holes 36.

In the embodiment of the invention shown in FIG. 4, the device is generally similar to the one illustrated in FIG. 2, except that c-section clamp 48 is narrowed.

In the embodiment of the invention shown in FIG. 5 it is generally similar to the one illustrated in FIG. 2, except two guide tracks 50 are defined by the addition of T-shaped leg 38 to modified body plate 60. Such an embodiment is useful when two rows of indicating symbol elements 20 are required to be viewed in the modified viewing aperture of slide 58.

Figure 6:
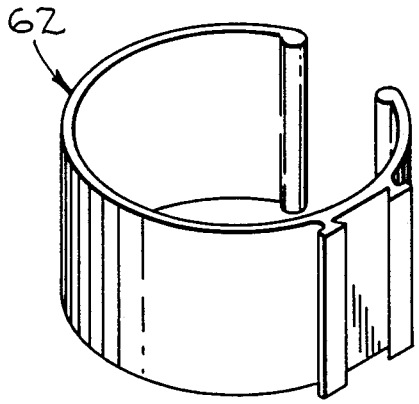
FIG. 6 is a perspective view of a second embodiment of the c-section clamp where the dove tail groove is at right angles to the opening of the c-section clamp.

In the embodiment in FIG. 6, body plate 44 is located 90° relative to the opening of alternate c-section clamp 62. Such an embodiment is useful if additional auxiliary labels would be attached to c-section clamp 62 or if the covering up of the container's original label is not desired.

Figure 7:
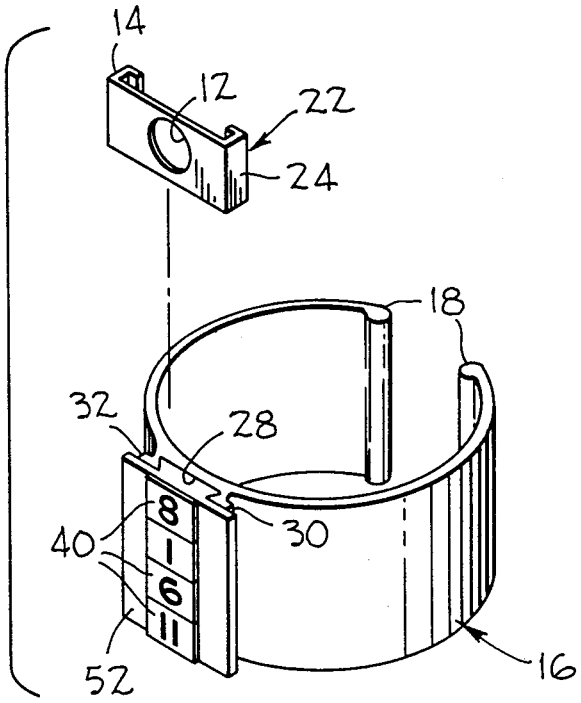
FIG. 7 is a perspective view of the preferred slide, clamp and a third embodiment of the body plate.

FIG. 7 illustrates an alternate body plate 52. This body plate is relatively flat and does not have guide track 2 like that in FIGS. 1 and 2. Such an embodiment would be useful if the use of pressure-sensitive symbol element labels 40 would be employed.

The components of this indicating device may be of plastic, metal, molded synthetic resin or any resilient material, so as to be extremely simple and economical to manufacture.

OPERATION OF INVENTION

By way of example, one description of operation will be made referring to one embodiment of the invention in FIGS. 1 and 2. The user first selects the desired symbol elements 20 that correspond to the user's medication schedule. These symbol elements would be in the form of pressure-sensitive labels that would be attached to a rectangular card. This card would then be inserted into guide track 4 of body plate 44. The user would then attach slide 22 with viewing aperture 12, which would slidingly embrace flanges 6 of body plate 44. Viewing aperture 12 is slidably adjusted relative to the guide track 2 along the line designated by the double-headed arrow in sliding direction 46 of FIG. 1, until the desired symbol element 20 is visible in viewing aperture 12. C-section clamp 16 would then be attached to body plate 44. This is accomplished by the use of a suitable tongue and groove arrangement, the resilient connection being achieved by the use of dove tail projection 26 of body plate 44, which would engage with dove tail groove 28 of c-section clamp 16. The invention would then be connected to the user's desired medication container simply by pushing it laterally against the container, which has the effect of causing the thickened ends 18 to spread and spring over the container. The body of c-section clamp 16 serves for the resilient gripping of the container thereby to ensure that the invention is held firmly thereto. The invention can be removed in similar fashion or simply by sliding the device off the end of the container.

After assembly of the invention the user slides the viewing aperture 12 to the first symbol element 20. After the administering of a dose of medication, the viewing aperture would be advanced to the next symbol element 20 along the guide track 2 in the direction shown by the double-headed arrow in sliding direction 46. This procedure would be repeated for each subsequent dose of medication. A new day would begin by sliding the viewing aperture to the first symbol element 20 and repeating the above described procedure.

Thus, the reader will see that the medication device of the invention provides a highly reliable, light-weight, easy-to-use, yet economical device which can be used by persons of almost any age. This invention would help the user know when to take and when they have missed a dose of medication.

While the above description contains many specificities, the reader should not construe these as limitations on the scope of the invention, but merely as exemplifications of preferred embodiments thereof. Those skilled in the art will envision many other possible variations that are within its scope. For example, skilled artisans will readily be able to change the dimensions and shapes of the various embodiments. They will also be able to make the device of alternative materials such as wood and metal. They can make many variations in the way the device is attached to a container. They can make the c-section clamp of metal so that it can accommodate a greater range in what it is attached to. Or attach the body plate to a container with the use of a strap or Velcro-type attachment. They can make the symbol elements of different colored indicia that are integral with the body plate. They can make the slide and viewing aperture lock into predetermined notches along the body plate that would keep the viewing aperture from inadvertently being moved to another symbol element. They can make the symbol elements of different colors to help the user easily idenfity them. Different shaped symbol elements could be used to identify each medication (e.g., a red heart for heart medication). In addition, the body plate and container could be manufactured to be one integral piece. This would be advantageous to drug companies as a promotional device. Accordingly, the reader is requested to determine the scope of the invention by the appended claims and their legal equivalents, and not by the examples which have been given.

We claim:

1. A device for affixing indicating indicia to an object comprising:

a c-shaped clamp having a pair of longitudinally aligned ribs means operable to grip said object;

a body portion having guide track means thereon;

indicating means slideably supported on said guide track means;

a plurality of symbol elements for distribution on a face of said body portion;

said indicating means including a viewing aperture for alignment with selected one or more of said symbol elements on said face of said body portion; and means for attaching said body portion to said clamp.

2. The indicating apparatus according to claim 1 wherein said symbol elements are detachable.

3. The indicating apparatus according to claim 1 wherein said symbol elements are numbers.

4. The indicating apparatus according to claim 1 wherein said symbol elements are letters.

5. The indicating apparatus according to claim 1 wherein said symbol elements are symbols.

6. A device for affixing indicating indicia to an object comprising:

a c-shaped clamp having a pair of longitudinally aligned substantially straight rib means being operable to grip said object;

a body portion having guide track means for slideably supporting an indicating means;

a plurality of indicium for distribution along said guide track means;

said indicator means defining a viewing aperture for alignment selectively with selected one or more of said indicium on said guide track means; and means for attaching said body portion to said clamp comprising a pair of L-shaped legs forming a dove tail groove on said clamp and a dove tail projection on said body portion slideably received within said groove.

7. The device of claim 6 wherein said means for attaching said body portion to said clamp comprises a plurality of pegs on said body portion and complementary holes in said clamp for receipt of said pegs.

* * * * *